US005360082A

United States Patent [19]

Bell

[11] Patent Number: 5,360,082

[45] Date of Patent: Nov. 1, 1994

[54] FALL PREVENTION AND LOWERING SYSTEM, METHODS OF USE AND BODY ENGAGEMENT MEANS UTILIZABLE THEREWITH

[76] Inventor: Michael Bell, 1705 Triumphe Way, Warrington, Pa. 18976

[21] Appl. No.: 910,157

[22] PCT Filed: Nov. 13, 1990

[86] PCT No.: PCT/US90/06609

§ 371 Date: Jul. 17, 1992

§ 102(e) Date: Jul. 17, 1992

[87] PCT Pub. No.: WO91/10475

PCT Pub. Date: Jul. 25, 1991

[51] Int. Cl.[5] ..... A62B 1/14

[52] U.S. Cl. ..... 182/3; 182/6; 244/151 R

[58] Field of Search ..... 182/3–7; 244/151 R; 119/96

[56] References Cited

U.S. PATENT DOCUMENTS

| | | | |
|---|---|---|---|
| 634,604 | 10/1899 | Asche . | |
| 2,290,745 | 7/1942 | Frankel . | |
| 2,339,328 | 1/1944 | Frankel . | |
| 2,432,741 | 12/1947 | Frankel . | |
| 2,436,167 | 2/1948 | Gregory | 244/151 R |
| 2,691,478 | 10/1954 | Frankel . | |
| 3,220,511 | 11/1965 | Holkesvick . | |
| 3,250,515 | 5/1966 | Hudnall . | |
| 3,869,021 | 3/1975 | Southerland . | |
| 4,076,101 | 2/1978 | Himmelrich . | |
| 4,090,584 | 5/1978 | Wagner . | |
| 4,378,921 | 4/1983 | Allen . | |
| 4,446,943 | 5/1984 | Murray . | |
| 4,508,193 | 4/1985 | Forrest . | |
| 4,512,437 | 4/1985 | Savage | 244/151 R X |
| 4,553,633 | 11/1985 | Armstrong . | |
| 4,560,029 | 5/1985 | Dalmaso . | |
| 4,598,792 | 7/1986 | Lew . | |
| 4,625,335 | 12/1986 | Vinai | 182/3 X |
| 4,657,110 | 4/1987 | Wolner . | |
| 4,714,135 | 12/1987 | Bell . | |
| 4,938,435 | 7/1990 | Varner . | |
| 5,136,724 | 8/1992 | Grilliot et al. | 182/3 |

FOREIGN PATENT DOCUMENTS

| | | | |
|---|---|---|---|
| 3216599 | 11/1983 | Germany | 182/3 |

*Primary Examiner*—Alvin C. Chin-Shue

*Attorney, Agent, or Firm*—Caesar, Rivise, Bernstein, Cohen & Pokotilow, Ltd.

[57] ABSTRACT

An integrated safety system (20) comprises a rope grab (100), a body engagement device such as a harness (200, 201) or waist belt to be worn by a person (22), a lanyard (104) and lowering device (300). The harness (200, 201), which also constitutes a part of the invention by itself, comprises a compartment (202) for the lowering device (300), and also a first connector (224), a second connector (220) and in one embodiment (201) additionally comprises a third connector (600). The lanyard (104) is securable to the first connector (224) of the harness (200, 201) and to the rope grab (100) to enable the person (22) to be suspended thereby in the event of a fall. The lowering device (300) is stored in the compartment (202) of the harness (200, 201) until needed and is arranged to be mounted on the safety line (28) by the person (22) while the person is suspended thereby after a fall. The second connector (220) of the harness (200, 201) is then readily connectable to the lowering device (300) by the person (22) as he/she is suspended by the rope grab (100). The method of using the safety system also constitutes a part of this invention.

20 Claims, 5 Drawing Sheets

FIG. 3
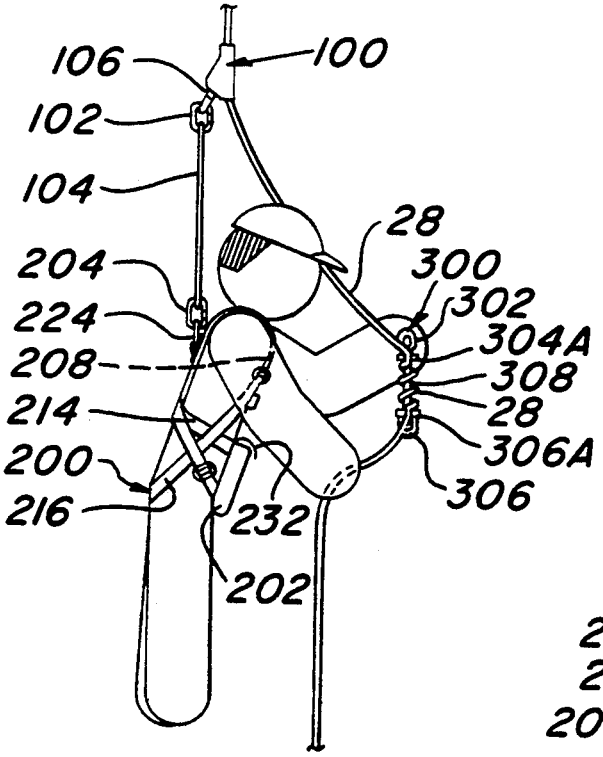
FIG. 4
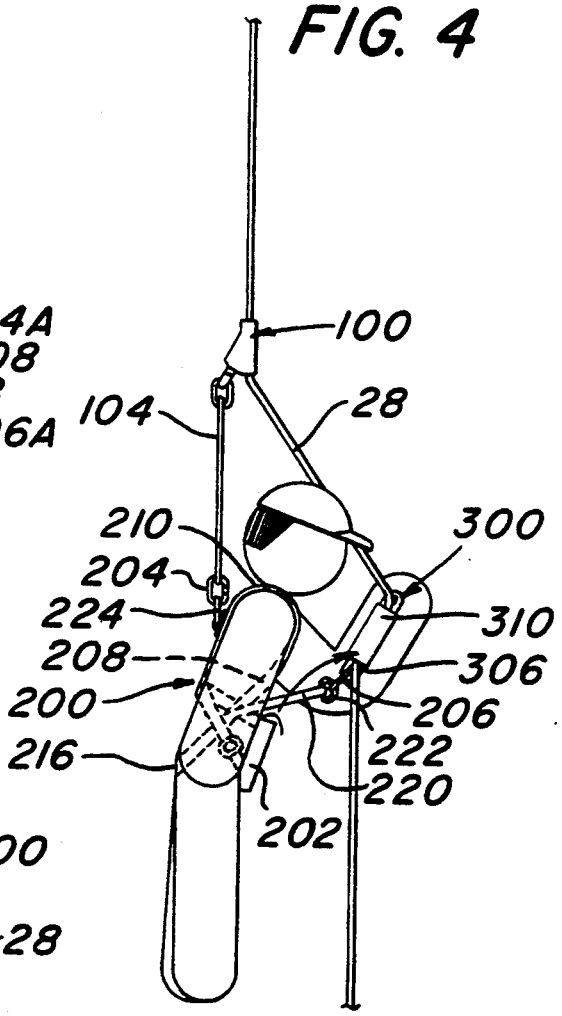
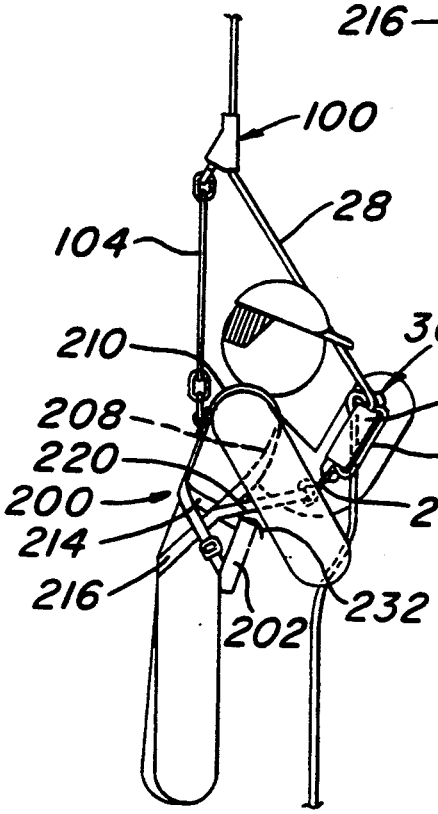
FIG. 5

FIG. 8
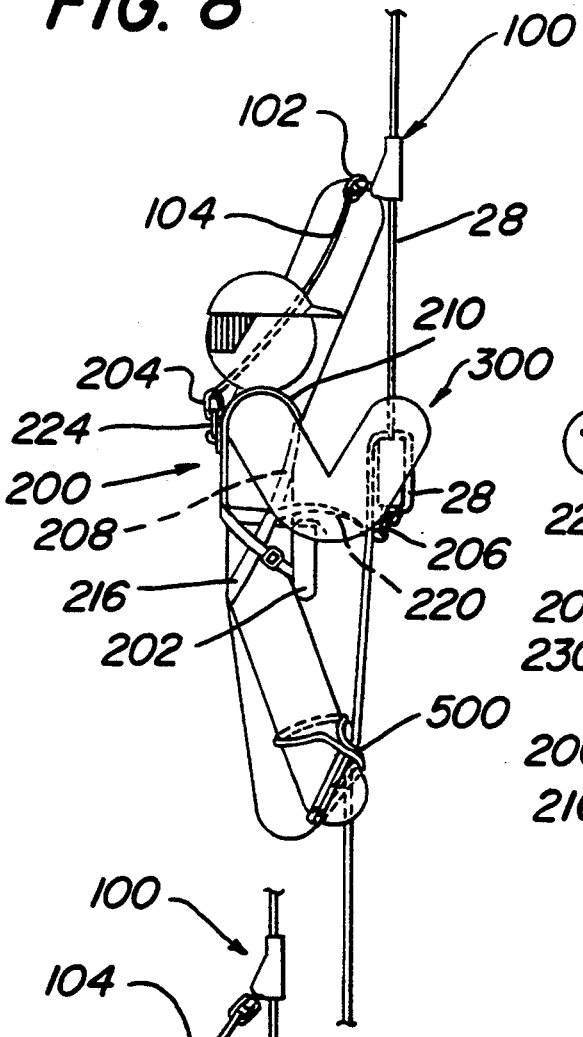
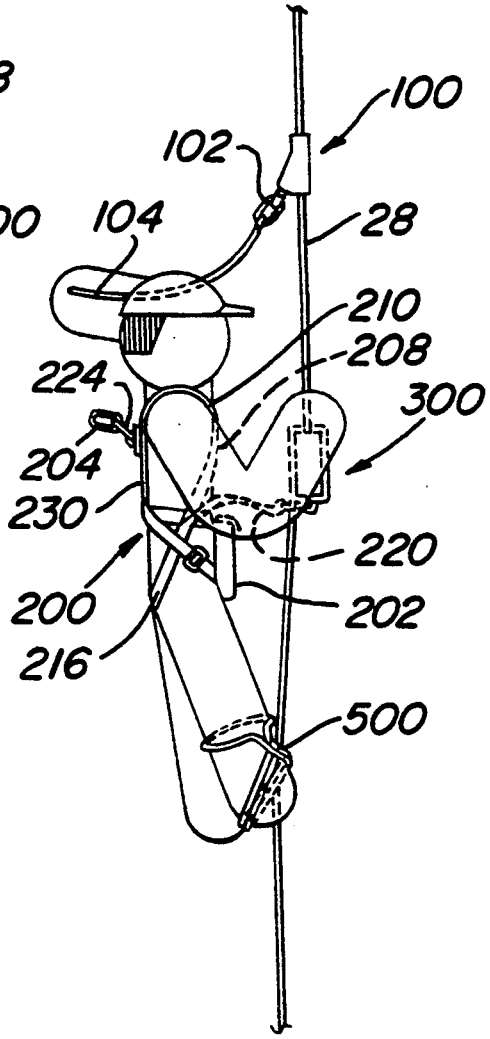
FIG. 7
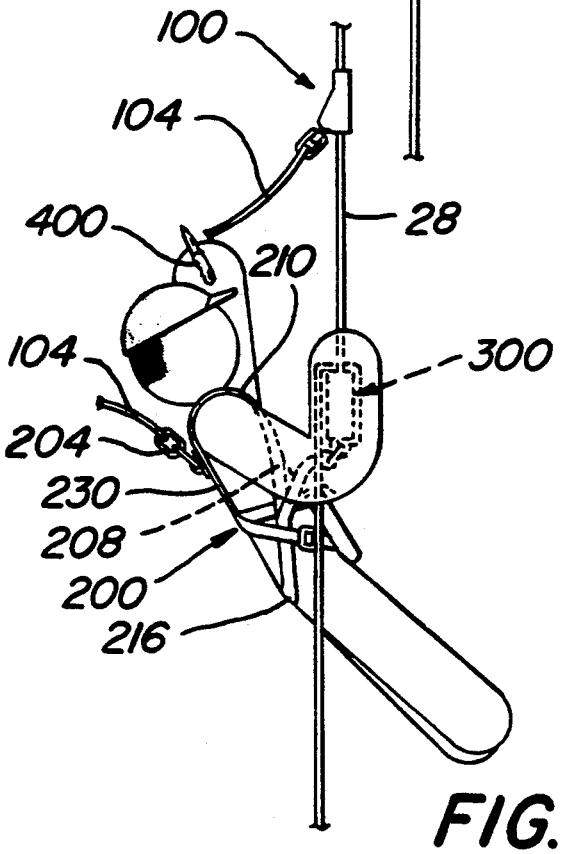
FIG. 6

FALL PREVENTION AND LOWERING SYSTEM, METHODS OF USE AND BODY ENGAGEMENT MEANS UTILIZABLE THEREWITH

BACKGROUND ART

This invention relates generally to safety systems and more particularly to a safety system, body engagement means utilizable therewith and methods of using the safety system for preventing a person from falling from an elevated position while enabling him/her to safely descend therefrom.

Safety devices, such as rope grabs or other similar devices, have become a requirement for workers working in elevated positions due to government regulations and a general desire for safety. Such devices are designed to be fastened to the worker via a safety waist belt or harness via a lanyard. The rope grab is then designed to be attached to a safety line which is attached to some elevated structure independently of the scaffold or other movable structure upon which the worker may be working and which extends down to the ground or some lower elevation.

Prior art rope grab devices and methods of use in a safety system leave much to be desired from the standpoint of functionality in that their use typically leaves the person suspended from the safety line until that person can be rescued by use of a ladder, "cherry picker" or some other device to enable the person to be brought to the ground.

One prior art rope grab device which overcomes some of the disadvantages of prior art rope grabs is an inertia rope grab system disclosed in U.S. Pat. No. 4,657,110 issued to J. Thomas Wolner. Devices made in accordance with that patent are available from DB Industries, Inc., of Redwing, Minn. 55066, and are sold under the trademark DBI/SALA, Model LS-1442. Such a device is removably fastened to a ¾" (19 mm) synthetic safety line and contains both an inertia and positive locking feature which enables the device to move along with the person as the person moves up or down with respect to the safety line, yet which grabs the safety line if the person should start to fall.

Other types of safety devices called "lowering devices" are disclosed in the patent literature and some are commercially available to enable an individual to safely control their descent down a rope. Those devices, while suitable for their intended purposes, do not protect an individual form an initial fall like a rope grab device. One such lowering device is that produced by Descent Control Inc., Fort Smith, Ark. as Model No. DT2&3 and is sold under the trademark SKY GENIE. The SKY GENIE device permits a person suspended from a safety rope to attach the device to the rope and control their descent down the rope. Examples of prior art lowering devices are found in U.S. Pat. Nos. 3,220,551 and 3,250,515. Other prior art lowering devices include the device commonly known as the "rack," sold by Fitch Industries, Idaho and the repelling device commonly known as a "figure eight."

Accordingly, a need exists for a safety system for preventing a person from falling from an elevated position while enabling him/her to safety lower himself-/herself in a controlled manner.

Prior art safety harnesses as well have suffered from numerous disadvantages. For example, it is believed that prior art harnesses have been difficult and time consuming for a person to initially put on prior to their ascent. Additionally, after a person wearing a prior art harness became suspended by the rope grab and safety line, the suspended person oftentimes found it very difficult to connect the harness to a lowering device such as the SKY GENIE lowering device, in order for the person to begin their self-actuated descent.

Accordingly, a need exists for a safety harness to be used in any type of system or environment for supporting a person at a position elevated from the ground.

Accordingly, a need exists for a safety harness to be used in any type of system or environment for supporting a person at a position elevated from the ground that also provides an alternative means of attachment to support that person from a safety line during use.

OBJECTS OF THE INVENTION

Accordingly, it is a general object of this invention to provide a safety system and methods of use which overcome the disadvantages of the prior art systems.

It is a further object of this invention to provide a safety system and methods of use for protecting persons located at elevated positions from falling while enabling such persons to safely descend.

It is a further object of this invention to provide an integrated safety system which is simple in construction, easy to use and which effectively protects a person from falling from an elevated position while enabling the safe controlled descent therefrom.

It is a further object of this invention to provide a safety harness which overcomes the disadvantages of the prior art harnesses.

It is a further object of this invention to provide a safety harness for protecting persons located at elevated positions from falling while enabling such persons to safely descend by rapidly and easily connecting the harness to a lowering system.

It is a further object of this invention to provide an safety harness which includes portions arranged to be releasably secured to various types of support or holding devices and which portions are normally maintained in a stowed position so that they do not interfere with the wearer of the harness or present any hazards of tangling.

SUMMARY OF THE INVENTION

These and other objects of this invention are achieved by providing an integrated safety system, methods of use and body engagement means utilizable therewith for protecting a person located at an elevated position from falling from the position, while enabling such person to safely descend to a lower position. The system comprises rope grab means, body engagement means, lanyard means and lowering means.

The body engagement means is arranged to be worn by the person and comprises storage means for the lowering means, first connection means, and second connection means. The preferred embodiment of the body engagement means is the harness which is described at length herein, although it should be readily apparent to those skilled in the art that a typical waist belt may be used instead.

The rope grab means is arranged for mounting on a rope extending from the elevated position to the lower position and comprises first support means and first actuable gripping means. The lanyard means comprises a rope having a connector loop at each end, the first of which is securable to the first connection means of the body engagement means and the second of which is securable to the first support means to enable the person to be suspended by the lanyard and rope grab means from the rope adjacent the elevated position. The first actuable gripping means is releasably actuable for securely grasping the rope to prevent the rope grab means from sliding down the rope when the person is suspended by the lanyard and rope grab means.

The lowering means is arranged to removed from the storage means and to be mounted on the rope by the person while the person is suspended on the rope by the lanyard and rope grab means. The lowering means comprises second support means and frictional engagement means. The second connection means of the body engagement means is arranged to be readily connected to the second support means by the person as the person is suspended by the lanyard and rope grab means. The frictional engagement means of the lowering means is actuable by the person to enable the lowering means to slide down the rope, thereby safely lowering the person.

The body engagement means may also include the safety harness of the invention to be worn by a person and to be attached to a first support means to hold the person at an elevated position. The harness is adapted to permit the person to readily connect and disconnect the harness to the first support means and to a second support means and comprises a plurality of flexible straps which are secured together, first connection means for releasably connecting the harness to the first support means, and second connection means for releasably connecting the harness to the second support means. The second connection means comprises at least one extendable strap having a first end fixedly secured to the harness and a second end releasably secured to the harness by releasable securement means so that the second end can be readily moved from a retracted position to an extended position. When the strap is in the retracted position, it does not interfere with the activities of the person, and when extended, permits the person to easily connect the free end to a second support means.

In accordance with one aspect of the method of this invention, the body engagement means is disconnected from the rope grab means before the frictional engagement means of the lowering means is actuated. This is accomplished by severing the lanyard means. Alternatively the person may form a looping in the rope to provide a foot support for him/her to take the his/her weight off of the lanyard means, whereupon he/she may disconnect the first connecting means from the lanyard means.

In accordance with another aspect of the method of this invention, the rope grab means is disengaged from the rope before the frictional engagement means of the lowering means is actuated. This is accomplished by the person forming a looping in the rope to provide a him/her with a foot support, whereupon he/she may reach up to the rope grab means to disengage it from the rope to enable it to slide down the rope as the person safely descends. If the person then descends too quickly, the rope grab means will then engage the rope to again suspend the person, who may perform the above steps to disengage the rope grab means and continue the descent.

DESCRIPTION OF THE DRAWINGS

Other objects and many attendant features of this invention will become readily appreciated as the same becomes better understood by reference to the following detailed description when considered in connection with the accompanying drawings wherein:

FIG. 3 is a side elevational view of the person shown in FIG. 2 in an early step in the process of lowering himself from the elevated position using the system of this invention;

FIG. 4 is a side elevational view of the person shown in FIG. 2 in a later step in the process of lowering himself from the elevated position using the system of this invention;

FIG. 5 is a side elevational view of the person shown in FIG. 2 in a still later step in the process of lowering himself from the elevated position using the system of this invention;

FIG. 6 is a side elevational view of the person shown in FIG. 2 in one mode of a still later step in the process of lowering himself from the elevated position using the system of this invention;

FIG. 7 is a side elevational view of the person shown in FIG. 2 in a second mode of said still later step in the process of lowering himself from the elevated position using the system of this invention;

FIG. 8 is a side elevational view of the person shown in FIG. 2 in a third mode of said still later step in the process of lowering himself from the elevated position using the system of this invention;

DETAILED DESCRIPTION OF THE PREFERRED EMBODIMENTS

Figure 1:
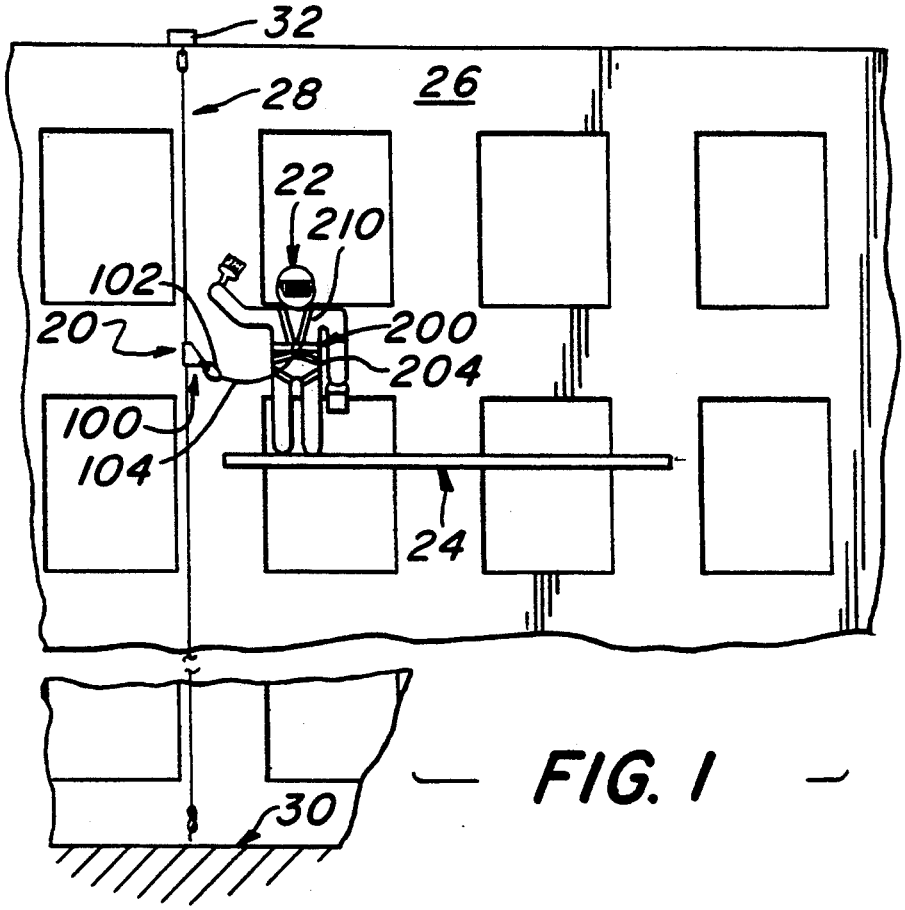
FIG. 1 is a front elevational view of a person utilizing the integrated safety system of this invention.

Referring now to various figures of the drawings where like reference numerals refer to like parts there is shown at 20 in FIG. 1 a safety system constructed in accordance with this invention for protecting persons located at elevated positions from falling while enabling such persons to safely descend.

In FIG. 1 a person 22 is shown connected to the safety system 20 of this invention in a typical manner of use. To that end the person is shown standing on a scaffolding 24 while painting a building 26 above the ground 30. The person is attached to a conventional safety line 28. The line 28 is secured to the building 26 by means 32 at an elevation higher than the person, with the line 28 extending downward to a position closely adjacent the ground 30.

The system 20 basically comprises the safety line 28, a conventional rope grab 100, a harness assembly 200, a lanyard 104 and a conventional lowering device 300 (FIG. 4), all of which will be described in considerable detail later.

Suffice to say for now that the person 22 utilizing the safety system wears the harness on his/her body trunk. The rope grab device 100 is mounted on the safety line and is connected to the harness connector 204, via the lanyard 104 and an associated snap ring 102 (see FIG. 2). Should the person fall 22 off the scaffold or the scaffold fall away, the rope grab 100 grasps the line 28 to suspend the person from the line and prevent the person from falling further. At this time, the suspended person may take the lowering device 300 (which is conveniently stored in a portion of the harness to be described later) and attach it to the safety line 28 and then release the connection between the harness and the rope grab device 100 to safely descend to a lower elevation, such as the ground. Alternatively, the person may release the rope grab 100 and use the lowering device 300 to safety descend in controlled steps to the ground. Further, the person may sever the lanyard 104 from the harness 200 and then descend the safety line via use of the lowering device 300.

Figure 10:
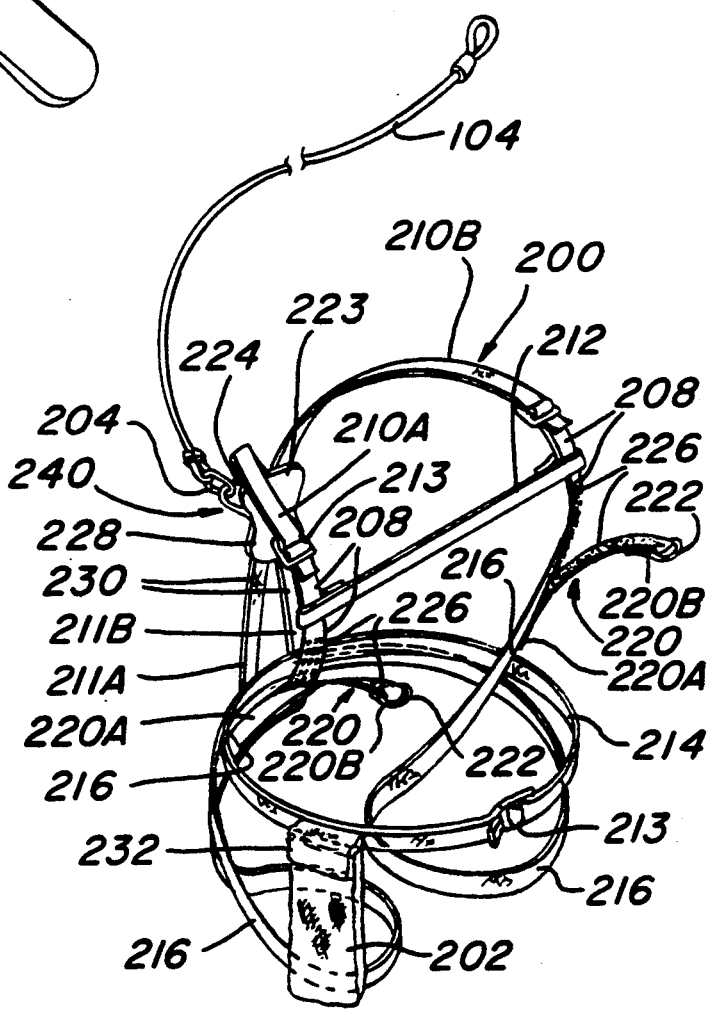
FIG. 10 is an enlarged perspective view of a portion of the safety system of this invention.

The first embodiment of the harness 200 is best seen in FIG. 10 and will be described in considerable detail later. Suffice for now to state that it includes a storage compartment or pouch 202 for holding the lowering device 300 and at least one connector, e.g., snap ring, clip or carabiner used in the system 20.

The connector 206 (see FIG. 4) is held within the pouch 202 of the harness and is used to connect the harness to the lowering device 300 when it is desired to utilize the lowering device to descend down the line 28. In this connection, the connector 206 is arranged to be connected to each respective loop on a pair of straps (to be described later) forming a portion of the harness 200, and to a loop or eyelet (to be described later) forming a portion of the lowering device 300.

Figure 11:
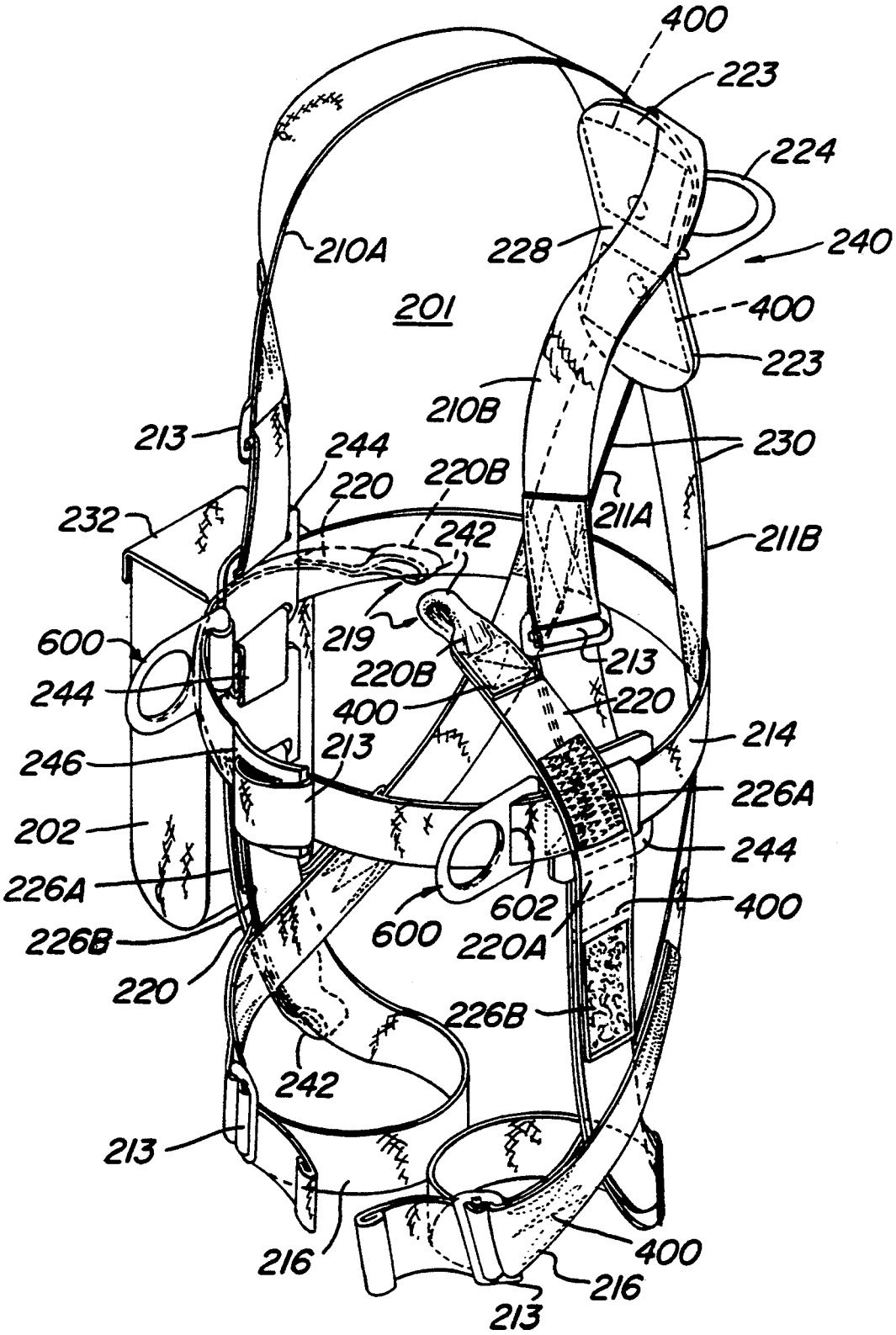
FIG. 11 is an enlarged perspective view of a portion of the second and most preferred embodiment of the harness of this invention.

A second and more preferred embodiment of the harness is shown in FIG. 11.

Figure 2:
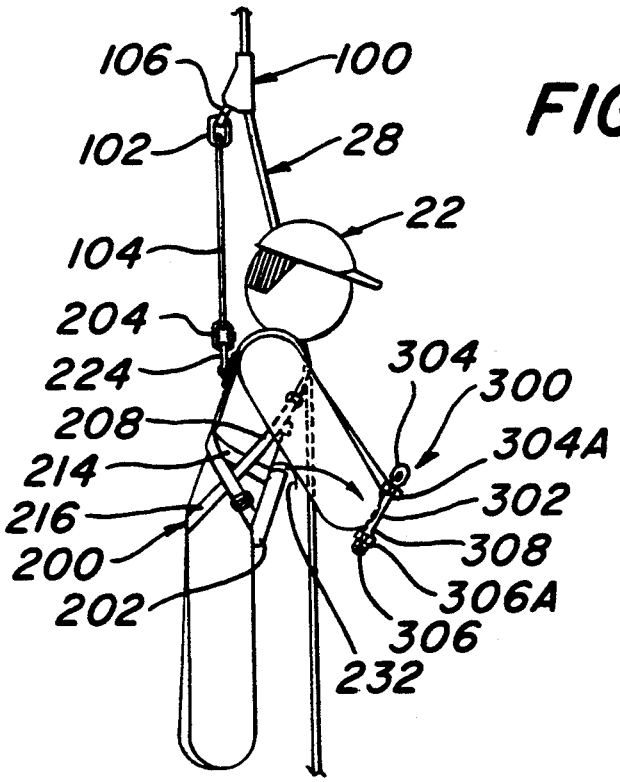
FIG. 2 is a side elevational view of the person shown in FIG. 1 after the support on which he was standing has dropped away whereupon the person is supported by the system of this invention.

In accordance with a preferred embodiment of this invention, the rope grab device 100 is the LS-1442 device sold by DB Industries, Inc. as mentioned earlier. This device is arranged to be mounted on the safety line 29 to frictionally engage the safety line at its point of engagement. As shown in FIG. 2, the rope grab 100 basically comprises a pivoting arm portion 106 having a eyelet or opening through which the connector 102 extends to secure the lanyard 104 to it. The portion 106 is coupled to an actuable gripping member or roller (not shown). The portion 106 is pivotable and spring biased to cause the gripping member to normally grasp the rope in a rolling arrangement to enable the device 100 to follow the person vertically down the rope when the person is working prior to falling. The portion 106 and associated actuable gripping member is arranged to tightly grasp the safety line 28 when a force is provided on the lanyard 104. As will be appreciated by those skilled in the art, such action occurs if the person 22 falls off the support 24 or if the support 24 otherwise falls away. In such an event, the person will be suspended by the rope grab 100 from the safety rope adjacent the elevated position as shown in FIG. 2.

In order to lower himself/herself, the person then makes use of the lowering device 300 of the safety system 20. Preferably the lowering device is the heretofore mentioned SKY GENIE device. To that end, a portion of the lowering device 300 is removed from the compartment 202 of the harness and is mounted on the safety line 28 as the person is suspended on the safety line by the rope grab device 100. This action is shown clearly in FIG. 2 and will be described in more detail later.

As can be seen, the lowering device 300 basically comprises an elongated body member 203 having a first eyelet or loop 304 at the upper end thereof, a second eyelet or loop 306 at the lower end thereof and a smooth cylindrical central portion 308 between the loops 304 and 306. A flange 304A projects outward from the central portion 308 immediately adjacent the loop 304. A similar flange 306A projects outward from the central portion 308 immediately adjacent the loop 306. The flanges 304A and 306A each are of circular profile and include a recess or notch in their periphery through which a portion of the safety line 28 is threaded. The device 300 is secured to the safety line by wrapping the line 28 in a spiral about the central portion 308 and threading the contiguous portions of the line through the respective recesses in the flanges 304A and 306A as shown in FIG. 3. For a slow descent, a person weighing between 150–200 pounds typically would wrap the line 28 around the central portion 308 approximately 5 turns. For each additional 50 pounds of weight, one additional turn of the rope would be necessary for a slow descent. A medium rate of descent for a person weighing between 150–200 pounds requires 4 turns of the rope about the shaft, with each additional 50 pounds of body weight requiring one additional turn of the rope.

Once this is accomplished, the suspended person then removes a cylindrical cover or shell 310 from the pouch 202 of the harness. The cylindrical shell 310 has an internal diameter just slightly larger than the external diameter of the flanges 304A and 306A. The sleeve has a longitudinal slot down its length through which the line 28 may be threaded to enable the sleeve 310 to be slipped over the body 302 of the device 300 so that there is frictional engagement between the various spirals of the loop and the contiguous portions of the body 302 and the cover 310. The device 30 also includes a thumb screw and detent mechanism (not shown) to hold the sleeve onto the body 302.

With the lowering device 300 mounted on the line 28, as just described, the person 22 then remove the connector 206 from the compartment 202 and connects it through the lower loop 306 of the lowering device 300 and through a pair of metal loops 222 (FIG. 10) mounted on respective ends of straps 220 of the harness (see FIG. 10). In the preferred embodiment of the harness, the pair of loops 222 are replaced by loops (to be described later) created at the harness strap ends 220 which are folded over and stitched, to which the connector 206 is attached.

Once the system 20 is connected as shown in FIG. 4, the person is ready to descend from the elevated position at which he/she is held by the rope grab 100. To that end, either the rope grab has to be released and moved down with the person as the person descends under the control of the operation of the device 300 or else the person must be disconnected from the rope grab 100.

Inasmuch as the person is now suspended from the rope grab 100, it is necessary to first "lock out" the lowering device 300 so that as soon as the person releases him/herself from the rope grab device 100, he/she will not immediately start to descend. To that end, the lowering device is "locked out" by looping the line 28 longitudinally around the device 300 like that shown in FIG. 5. This action increases the frictional engagement of the line 28 with the device 300 so that the device 300 cannot slide down the line even when all the person's weight is suspended from the device.

Figure 9:
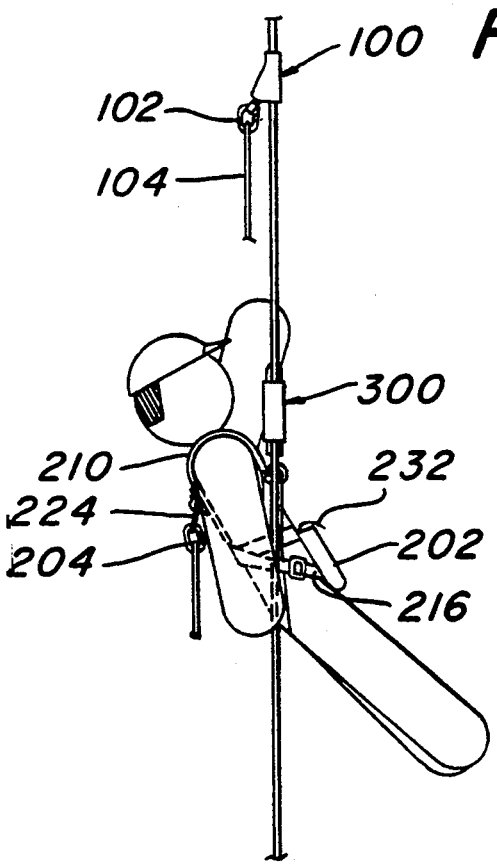
FIG. 9 is a side elevational view of the person shown in FIG. 2 in an end step in the process of lowering himself from the elevated position using the system of this invention.

Once the lowering device 300 is "locked out" as shown in FIG. 5, the person 22 is then ready to begin a controlled descent down line 28. This can be accomplished in a number of ways. In one way, shown in FIG. 6, the person 22 releases himself/herself from the rope grab by removing a knife 400 or other cutting instrument from the compartment 202 of the harness 200. This knife is used to sever the lanyard 104. The person may then release the device 300 so it is able to slide down the line. Inasmuch as the lowering device 300 is locked out by the wrapping of the line 28 about the device 300 (as was accomplished previously and shown in FIG. 5), the person will be suspended from that position by the device 300 until the line 28 is unlooped therefrom, thereby releasing the "lock out." Once the lowering device is no longer locked out, the person is then able to slide down the line 28 in a controlled fashion due to the frictional engagement of the spirals of the line 28 about the body portion 302 of the device within the cover 310. This lowering action is shown by FIG. 9.

In lieu of severing the lanyard 104, and in accordance with another aspect of this invention, the person 22 may disconnect the connector 204 connecting the lanyard to the harness as shown in FIG. 7. In this regard, since the person is suspended by the lanyard and harness as shown in FIG. 5, there will be no slack in the lanyard to enable either of the connectors 204 or 102 to be readily removed. Accordingly, in order to provide some slack in the lanyard to enable either connector to be removed or opened, the person 22 reaches down to loop the line 28 about his/her foot at an elevation above the normal position of his/her foot to provide a step up on the line and thereby provide some slack in the lanyard. One preferable type of loop that can be used is the so-called "cinch knot chicken loop." That loop is formed by forming a loop in the line 28, wrapping that loop over the person's instep under the arch, over the instep from the other side of the foot and around the ankle as shown in FIG. 7 and designated by the reference number 500. Once the cinch knot chicken loop 500 is formed in the step up position, the person 22 can then either disconnect the connector 204 (as shown in FIG. 7) or can disconnect the connector 102. Once this is accomplished, the person will not immediately begin to descend until he/she releases the cinch knot chicken loop 500 and also releases the "lock out" of the lowering device 300. Once those actions are accomplished the person will then descend to the ground in the same manner as shown in FIG. 9.

Yet another mode of descending to the ground in accordance with the method of this invention is shown in FIG. 8. In that mode of operation the person does not release himself/herself from the rope grab 100. Instead, the person sequentially releases the rope 100 grab to allow it to slide down the line 28 as the lowering device 300 slides down the line. This mode of operation may take place in a number of short descending steps and will thus be more time consuming. However, this mode of descent has the advantage that it provides a much more safely controlled manner of descent since the person only descends a short distance at the time.

To accomplish this sequential manner of descent once a person is stopped at any elevation by the grasping of the device rope grab 100 onto line 28, the person then locks out the lowering device 300 (as described earlier) and then forms the "cinch knot chicken loop" as also described earlier. The person 22 then uses the "cinch knot chicken loop" as a step up to reach the rope grab 100 and release its actuating member. This action enables the rope grab 100 to slide down the line again after the person releases the "cinch knot chicken loop" from his/her foot and releases the lock out of the lowering device. This action enables the lowering device 300 to slide down the line 28 until an excessive pulling force is applied via lanyard 104 to the rope grab 100 to cause it to grab the line 28 or until the person pulls on the member 106 of the rope grab to cause it to grip the line.

If the person begins accelerating at an excessive rate due to the force of gravity, the rope grab 100 may engage the line to stop the person from descending further. If this occurs, the person may then disengage the rope grab as previously described, and descend to a lower elevation or descend until the increase in the acceleration rate causes the rope grab to engage the safety rope and stop the descent.

Referring now to FIG. 10, the details of the first embodiment of the safety harness 200 will be seen. As shown in FIG. 10, the harness 200 comprises a plurality of flexible straps, such as formed of a high-strength woven plastic fabric, which are secured together, e.g., stitched to form the assembly as shown. The harness comprises a pair of chest straps 208 which criss-cross at the rear of the harness at joint 228 to merge into a cross-chest strap 212, a waist strap 214 and a pair of leg straps 216. The leg straps merge into the chest straps. At the joint 228 is a metal loop 224 through which the connector 204 is placed to secure the lower end of the lanyard 104 to the harness 200.

The connectors 102, 204 and 206 may be of any suitable construction, such as a standard metallic ring or D-type connector (sometimes called a "carabiner".)

As shown in FIG. 10, each strap 220 is fixedly secured at its lower end to a respective leg strap 216 and extends therealong toward the associated chest strap. The connector straps 220 include on their inner surface one component (e.g., the multi-hook component), of a VELCRO fastening system 226. The other and cooperating (e.g., the multi-loop) component of the VELCRO fastening system 226 is secured to the front face of each of the associated leg straps and merging from straps. Thus, each strap 220 can be held tightly against the associated harness straps 208 and 216 in normal operation. However, when it is desired to connect the harness 200 to the lowering device 300, the two connecting straps 220 can be peeled away so that they extend therefrom but are fixedly connected at their lower end thereof to the leg straps 216.

In the first embodiment of the harness shown in FIG. 10, at the free end of each of the connector straps 220 is a D-shaped metal loop 222 fixedly secured thereto. Each loop serve as the means for connecting the associated strap 220 to the loop 306 on the lowering device, via the connector 206. The connector 206 may be connected to the metal loops 222 located at the lower end of the straps 220 when the harness is initially worn by the person or may be stored in the storage compartment 202 until needed. Alternatively, the metal loops 222 may be omitted and are replaced by loops (not shown) at each end of the straps 220 formed by folding over the free ends of the straps and stitching them in the same manner as the rest of the harness.

As can be seen, the storage compartment or pouch 202, comprises a pocket or bolster type construction having an upper flap 232 which is releasably secured to the bolster to insure that none of the components held within the compartment fall out. The flap 232 may be held in place by any releasable securement means, such as VELCRO strips.

The second and most preferred embodiment of the harness is shown at 201 in FIG. 11, and is constructed in a similar manner and of like materials as the harness 200.

Common components are given the same reference numbers in both embodiments in the interest of brevity. The harness 201 has advantages over harness 200 due to its simple construction and ease of use. As can be seen, the harness 201 comprises a plurality of flexible straps, which are secured together, e.g., by stitching 400. Additionally, the harness 201 comprises first connection means 204 for releasably connecting the harness to a lanyard 104, rope or other apparatus, and second connection means 219 for releasably connecting the safety harness 201 to a lowering means 300 or other apparatus.

In the second embodiment shown in FIG. 11, the harness 201 also preferably comprises a storage means or compartment 202 for storing a lowering device or other apparatus. In addition, the harness also includes two conventional D-rings 600. These rings are located adjacent the wearer's hips and are arranged to be connected to some means (not shown) for suspending the apparatus and the person wearing it so that the person may perform any activity desired.

The plurality of flexible straps of the harness 201 include those which are used to form the torso engagement portion of the harness comprising first and second shoulder straps 210A and 210B, respectively, having rear ends 211A and 211B, respectively. In this embodiment of the harness, the straps 210A, 210B pass over the wearer's shoulders towards the wearer's back, and crisscross at a joint 228, so that the rear portions 211A and 211B are secured to the rear of the waist strap 214. The waist strap includes an adjustable waist buckle 246. The frontal portions of the shoulder straps 210A and 210B extend downward to form the leg engagement means. That means comprises at least one loop or leg strap 216, through which the person places at least one, or preferably both of his/her legs.

Although it is not necessary that the straps 210A and 210B criss-cross in the rear, it is preferable that they do so in order to more assuredly secure the wearer within the harness.

If desired, depending upon the circumstances of use, all the straps of the harness 201 may be adjustable by use of buckles 213. Additionally, it is preferable that the harness 201 comprise strap buckles 244 which aid in maintaining the straps of the harness 201 in proper alignment so that the wearer does not slip therethrough. Although any suitable material may be used, it is preferable that the strap buckles 244 be comprised of leather or plastic.

The first connection means 240 preferable comprises a metal loop 224 attached to the harness 201. In the harness 201, the first connection means comprises a joint 228 having the metal connector or loop 224 attached to a strap fastener 223, through which a connector (not shown) is placed to secure the lower end of the lanyard 104 or other apparatus to the harness 201. The connectors (such as connectors 204 and 224 shown in FIG. 10) may be of any suitable construction, such as a standard metallic ring or D-type connector.

The second connection means 219 comprises at least one, flexible, extendable strap 220. In the harness 201, a pair of such straps are used for both additional balance and strength. As can be seen in FIG. 11, each strap 220 has a first end portion 220A fixedly secured to a respective leg second end 220B of each strap 220 includes the heretofore identified connector loop 242 for releasable connection to a lowering means 300 or other apparatus. The loop 242 is formed by folding over the free end of each additional strap 220 and is then secured in place by stitching 400 or other conventional means.

The extendable straps 220 include on one side of their inner surface the hook component 226B of a VELCRO fastening system. The other cooperating loop component 226A of the VELCRO fastening system is secured to the front face of each of the straps 220. Thus, while wearing the harness while performing the desired job, exercise, etc., each strap 220, can be held tightly against the associated leg straps 216 in a normal or stowed position. This ensures that the straps do not interfere with the wearer's activities or present any tangling hazard. However, when it is desired to connect the harness 201 to a lowering device or other apparatus, the two extendable straps 220 can be peeled away from the harness leg straps 216 so that they extend therefrom but are fixedly connected at their lower end 220A thereof to the straps 216. Once extended, they may be easily connected to whatever support means are desired, e.g., a lowering device. If necessary, the connector loops 242 may first be connected to a suitable metal connector (e.g., 204 shown in FIG. 10), which is(are) stored in the pouch 202 and then connected to a lowering device or other apparatus. Alternatively the loops 242 may be directly connected to another device.

As can be seen in FIG. 11, the storage compartment or pouch 202 comprises a pocket or bolster type construction having an upper flap 232 which is releasably secured to the bolster to insure that none of the components held within the compartment fall out. The rear of the pouch 202 is most easily secured to the harness 201 by first securing it to a leather or plastic strap buckle 244. Although it is preferable that the pouch 202 be secured below the waist strap 214 to minimize interference with a worker, it should be readily apparent to one skilled in the art that it may be secured in any appropriate manner and place. The flap 232 may be held in place by any releasable securement means, such as VELCRO strips. This compartment is particularly suited for storing the connectors 222, the descent lowering device, etc., of the safety system, but can be used to hold anything that might be desired by the user and which could fit therein.

The previously mentioned D-rings 600 are used for example, to connect the safety harness 201 to some tie-off means. Each D-ring 600, includes a transversely extending slot 602. This slot serves as the means to secure the D-ring to the waist belt of the harness. Accordingly, each D-ring 600 is fixedly secured to the waist belt, but is free to pivot about an axis parallel to the slot 602 to facilitate the connection of the safety harness 201 to the tie-off means.

Without further elaboration the foregoing will so fully illustrate my invention that other may, by applying current or future knowledge, adopt the same for use under various conditions of service.

I claim:

1. A safety harness to be worn by a person and to be attached to a first support means to hold the person at an elevated position, said harness having a front portion and a rear portion and being adapted to permit the person to readily connect and disconnect said harness to said first support means and to a second support means, characterized in that said harness comprises a plurality of flexible straps which are secured together, first connection means for releasably connecting said harness to said first support means, second connection means for releasably connecting said harness to said second support means, said second connection means comprising a pair of extendable straps each of said straps having a first end fixedly secured to said harness adjacent a respective hip of the person and a second end releasably secured to said harness by respective releasable securement means so that said second end can be readily moved from a retracted position to an extended position, wherein when each of said extendable straps is in said retracted position it is located adjacent said rear portion of said harness so that said strap does not interfere with the activities of said person, and wherein when each of said extendable straps in said extended position it projects outward from said front portion of said harness to permit said person to easily connect said free end to said second support means.

2. The harness of claim 1 characterized in that said respective releasable securement means each comprise a first component having a plurality of hooks and a second component having a plurality of loops, whereupon when said first and second components are brought into engagement said hooks and loops interact to hold said components together.

3. The harness of claim 2 characterized in that a respective one of said components of said respective releasable securement means is fixedly secured to one of said extendable straps and a respective other of said components is secured to a respective portion of said harness.

4. The harness of claim 1 characterized in that said plurality of flexible straps comprises a waist strap to be wrapped around said person's waist, torso engagement means for securing said person's torso, and leg engagement means for securing at least one of said person's legs.

5. The harness of claim 4 characterized in that said torso engagement means comprises a first and second shoulder strap, each of said first and second shoulder straps having a front and rear end, said rear ends of said shoulder straps secured to said waist strap at the rear of said person, each of said front ends of said shoulder straps extending to form said leg engagement means comprising a loop through which said person may place at least one of said person's legs for support.

6. The harness of claim 5 characterized in that said torso engagement means additionally comprises a chest engagement strap.

7. The harness of claim 6 characterized in that said chest engagement strap comprises a generally horizontal chest strap connected to said first and second shoulder straps in the front of said person, generally at said person's chest.

8. The harness of claim 5 characterized by a joint wherein said shoulder straps are substantially parallel in the front of said person and securedly criss-crossed at said joint in the rear of said person so that said rear ends of said shoulder straps are secured to said waist strap at the rear of said person.

9. The harness of claim 7 characterized by a joint wherein said shoulder straps are substantially parallel in the front of said person and securedly criss-crossed at said joint in the rear of said person so that said rear ends of said shoulder straps are secured to said waist strap at the rear of said person.

10. The harness of claim 4 characterized in that said plurality of flexible straps comprise high-strength, woven-plastic.

11. The harness of claim 5 characterized iun that said first and second shoulder straps and said waist strap are adjustable.

12. The harness of claim 1 characterized in that said at least one extendable strap additionally comprises a connector member for releasable connection to said second support means.

13. The harness of claim 12 characterized in that said connector member comprises a metallic carabiner.

14. The harness of claim 1 additionally characterized by a storage means for storing components of the system.

15. The harness of claim 14 characterized in that said storage means comprises a pocket with a releasably secureable flap.

16. The harness of claim 1 characterized in that the harness additionally comprises third connection means for alternatively connecting the harness.

17. The harness of claim 16 characterized in that the third connection means comprises at least one connector member secured to the harness.

18. The harness of claim 17 characterized in that the at least one connector member is secured to the waist strap of the harness and comprises a D-ring.

19. The harness of claim 17 characterized in that the at least one connector member comprises two connector members secured to the waist strap of the harness adjacent the hips of the person.

20. The harness of claim 19 characterized in that each connector member comprises a D-ring.

* * * * *